US005303485A

United States Patent [19]

Goldston et al.

[11] Patent Number: 5,303,485

[45] Date of Patent: Apr. 19, 1994

[54] FOOTWEAR WITH FLASHING LIGHTS

[75] Inventors: Mark R. Goldston, Santa Monica; Jon L. Bemis, Rancho Palos Verdes; Mariamia Godinez, Sherman Oaks, all of Calif.

[73] Assignee: L.A. Gear, Inc., Santa Monica, Calif.

[21] Appl. No.: 13,839

[22] Filed: Feb. 5, 1993

[51] Int. Cl.[5] ..... A43B 23/00

[52] U.S. Cl. ..... 36/137; 200/310; 200/317

[58] Field of Search ..... 36/137, 139; 200/60, 200/61.1, 310, 311, 317

[56] References Cited

U.S. PATENT DOCUMENTS

| | | | |
|---|---|---|---|
| 1,933,243 | 10/1983 | Merolis et al. . | |
| 2,189,676 | 2/1940 | Pfohl | 200/310 |
| 2,931,893 | 4/1960 | Arias et al. . | |
| 3,008,038 | 11/1961 | Dickens et al. . | |
| 3,070,907 | 10/1963 | Rocco . | |
| 3,800,133 | 3/1974 | Duval . | |
| 3,893,247 | 7/1975 | Dana | 36/2.5 |
| 4,014,115 | 3/1977 | Reichert . | |
| 4,130,951 | 12/1978 | Powell | 36/137 |
| 4,138,861 | 12/1978 | Pelengaris | 362/103 |
| 4,158,922 | 6/1979 | Dana | 36/137 |
| 4,253,253 | 3/1981 | McCormick | 36/137 |
| 4,417,114 | 11/1983 | Larson | 200/310 X |
| 4,848,009 | 7/1989 | Rodgers | 36/137 |
| 5,033,212 | 7/1991 | Evanyk | 36/137 |
| 5,052,131 | 10/1991 | Rondini | 36/137 |
| 5,188,447 | 2/1993 | Chiang et al. | 36/137 X |

FOREIGN PATENT DOCUMENTS

| | | | |
|---|---|---|---|
| 0121026 | 10/1984 | European Pat. Off. . | |
| 0335467 | 10/1989 | European Pat. Off. . | |
| 2608485 | 9/1977 | Fed. Rep. of Germany | 36/137 |
| 3343897 | 5/1983 | Fed. Rep. of Germany . | |
| 570614 | 9/1958 | France . | |
| 8005050 | 8/1980 | Netherlands . | |
| 444392 | 3/1936 | United Kingdom . | |

*Primary Examiner*—Paul T. Sewell
*Assistant Examiner*—Ted Kavanaugh
*Attorney, Agent, or Firm*—Don C. Lawrence

[57] ABSTRACT

Footwear (1) adapted to enhance the visibilty of the wearer contains a light source (12), a power source (14), circuitry (15, 16, 17) to connect the power source (14) to the light source (12) , and a pressure switch (18) disposed in the sole (5) of the footwear (1) between the wearer's foot and the ground and adapted to turn the light source (12) off when the wearer's foot is on the ground, and hence static, thereby conserving the power source (14), and to switch the light source (12) on when the wearer's foot is off the ground, and usually moving, thereby providing enhanced visibility of the footwear (1) and its wearer.

20 Claims, 2 Drawing Sheets

FOOTWEAR WITH FLASHING LIGHTS

BACKGROUND

1. Field of the Invention

This invention pertains to footwear in general, and in particular, to footwear with lights that flash to enhance the visibility of the wearer.

2. Description of the Related Art

It has long been known in the field of footwear to incorporate lighting devices, usually electrical in nature, into shoes, boots, sandals and the like for various reasons, e.g., to permit the wearer to see or be seen in reduced light situations, or to provide special effects during certain entertainment events.

A simple implementation of this type of footwear typically includes a light source, e.g., an incandescent bulb, a neon tube, or a light emitting diode ("LED"), a portable power supply, such as a battery, a manually operated on-off switch, and an electrical circuit connecting the three in series, all located in the footwear, typically within the sole and/or heel structures. Examples of these in the patent art may be found in the sandal of B. Arias et al. in U.S. Pat. No. 2,931,893, in the high heel shoe of A. McCormick in U.S. Pat. No. 4,253,253, and in the dress shoe heel described by W. Pahde in German Patent Application 3343-897-A.

More complex lighted footwear efforts have been directed to switching the lighting circuit on and off in association with the presence or absence of the wearer's foot in the shoe, or by the contact of the wearer's foot with the ground, e.g., during walking or running. Examples of the former in which the lighting circuit is switched on when the wearer's foot is inserted into the shoe include the houseshoe in U.S. Pat. No. 3,008,038 to M. Dickens et al., and the high heel described in Dutch Patent Application No. 8,005,050 by J. de Nijs, et al. The latter reference also includes means for automatically deactivating the lighting circuit under conditions of high ambient light.

Examples of footwear lighting circuits activated by a switch disposed in the sole of the shoe and actuated by pressure exerted on it by the underside of the wearer's foot in contacting the ground may be found in: U.S. Pat. No. 3,800,133 to H. Duval; U.S. Pat. No. 4,014,115 to R. Reichert; U.S. Pat. No. 5,052,131 to P. Rondini; and, Belgian Patent Application No. 570,614 to E. Abramovitch et al. A more elaborate example involving a pneumatically actuated switch is described in European Patent Application No. 335,467A by A. Heister, et al.

Examples of footwear lighting circuits activated by a switch disposed in the sole of the shoe and actuated by pressure exerted on it by the ground when the shoe contacts the ground may be found in: U.S. Pat. No. 1,933,243 to J. De Merolis et al; U.S. Pat. No. 3,070,907 to J. Rocco; U.S. Pat. No. 4,128,861 to A. Pelengaris; U.S. Pat. No. 4,130,951 to A. Powell; and, British Patent No. 444,392 to J. Jordan.

Examples of footwear containing lighting circuits activated by the angular position of the footwear include those found in U.S. Pat. Nos. 3,893,247 and 4,158,922, both to A. Dana, III, and U.S. Pat. No. 4,848,009 to N. Rodgers.

Each of the three examples in the latter group involves a "tilt switch," i.e., a mercury switch, to sense the angular position of the shoe with respect to the gravity gradient and to activate the circuit at a particular attitude. In the first two of these, the lights are on so long as the shoe is in a given attitude, and off in a second attitude, and both references require a master switch to deactivate their respective circuits unconditionally of the footwear's angular position. The last reference incorporates an electronic timing and "latching" circuit that turns the lighting circuit off a predetermined period of time after the switch is closed, and maintains it in the off state until the switch is first opened, then closed again. Thus, in each of these latter examples, the on-off condition of the light circuit is a function of the angular position of the footwear, and in particular, that of the tilt switch, relative to the gravity gradient, and is independent of any translational movement of the footwear or its position relative to the ground surface.

Each of the above-described examples of the relevant art is subject to certain shortcomings. Those that are "on" continuously tend to exhaust their batteries more quickly than those that are on only intermittently.

Those that are "on" only when the foot is in contact with the ground or in a certain angular position and otherwise "off" are not as effective as they might be for two reasons. First, the footwear is more likely to be obscured by, e.g., grass or uneven terrain when the foot is at ground level than when it is above the ground, and generally, the higher the light is above the ground, the further away it can be seen.

Secondly, in normal walking or running activities, the footwear, and hence, the light sources, are typically static, or unmoving, when the footwear is on the ground, and moving only when the footwear is above the ground. Two psychophysical phenomena act to ensure that the moving lights will be more readily seen than the static ones: First, in a static field, a moving object is more easily detected by the eye than a static one. Second, under appropriate lighting conditions, a moving point source of light is perceived, due to the phenomenon of "persistence," by the human eye (and some cameras) as a large, elongated streak of light "painted" on the retina of the eye by the point source, rather than as a small, moving point of light.

The present invention overcomes the limitations of the art described above and enhances the visibility of the wearer by the provision of a simple, economical and reliable design for footwear containing a lighting system that is "off" when the wearer's foot is contact with the ground, and unmoving, thereby conserving battery life, and "on" when the wearer's foot is off the ground, and usually moving, thereby enhancing the wearer's visibility for the reasons given above.

SUMMARY OF THE INVENTION

The novel footwear of this invention comprises a light source, preferably an LED, mounted in the footwear such that light emitted from the source is visible exteriorly of the footwear, and a power source, e.g., a battery, disposed in the footwear for energizing the light source. An electrical circuit connects the power source to the light source.

A pressure- or force-sensing switch, which is normally in a closed state, but which opens when pressure or force of a predetermined level is applied to it, and which returns to the closed state when the pressure or force is reduced below that level, is mounted in the sole, preferably in the heel region, of the footwear between the ground and the wearer's foot. The switch in interconnected within the circuit to connect and disconnect the power source to and from the light source when closed and open, respectively, so that the light source is off when the wearer's weight bears on the ground through the sole, and on when the wearer lifts the footwear from the ground.

In a preferred embodiment, the footwear includes a switch moderator that permits the level of force exerted on the switch by the wearer's foot to be adjusted or tuned to a desirable level during manufacture.

In another alternative preferred embodiment, one particularly suited to the mounting of a plurality of light sources in the sidewall of the footwear's sole, a light source mounting and connector assembly can be provided which conveniently serves both to mount and hold the light sources in a predetermined position relative to the sole portion sidewall margin, and to electrically connect the light sources to the balance of the lighting circuit.

In yet another alternative preferred embodiment, the battery can be made plug-in replaceable from the outside of the shoe for convenient maintenance, and, where the light sources are "unidirectional," i.e., responsive to applied voltage of only one polarity, such as in the case of LED's, this plug-in feature can also serve as a convenient lighting circuit "defeat switch," or means for the wearer to deactivate the lighting circuit when not in use, by the simple expedient of removing the battery and plugging it back in with its polarity reversed.

A better understanding of the footwear of the present invention and a greater appreciation of its attendant advantages may be had from a consideration of the following detailed description of its preferred embodiments, particularly if the description is considered in conjunction with the accompanying drawings. A brief description of these drawings now follows.

DETAILED DESCRIPTION OF THE PREFERRED EMBODIMENTS

Figure 1:
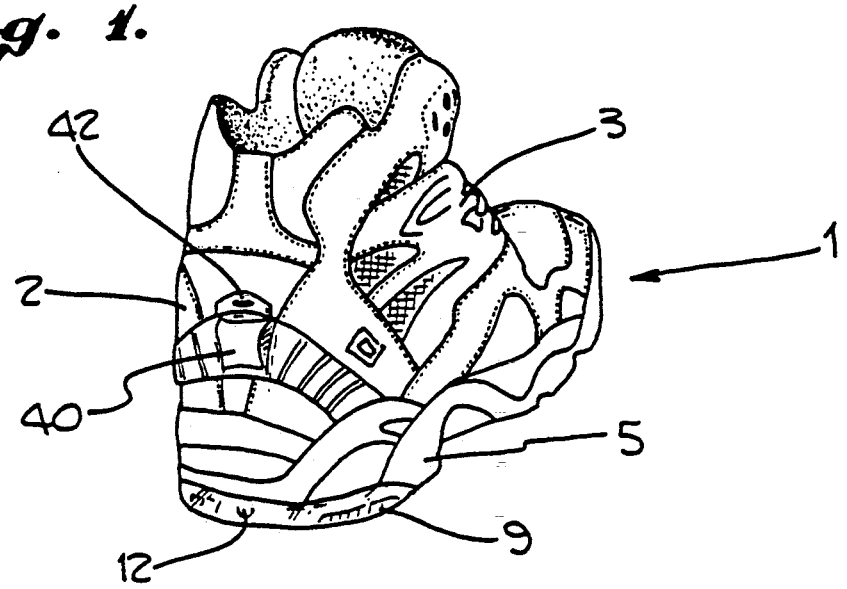
FIG. 1 is a rear perspective view of footwear, an athletic shoe, that incorporates the novel lighting system of the present invention.

FIG. 1 illustrates a type of footwear to which the present invention is readily adapted, namely, an athletic shoe 1. In recent years, such footwear has seen an enormous growth in sales, and it is favored by wearers of all ages, not only for athletic activities involving walking, running and jumping, such as basketball, football, soccer, baseball, tennis, etc., but also for casual wear at work, in the home, and on the streets.

The athletic shoe 1 shown in the figures is exemplary of such footwear, and typically includes an upper portion 2 that surrounds and encloses the upper surf aces of the wearer's foot, including the toes, instep, sides, ankle and upper heel. It may include a tongue that overlies the instep surface of the foot, as well as the mechanical features used to fasten the shoe to the wearer's foot, such as laces 3, straps or other such mechanisms.

The upper portion 2 is typically made of a soft, thin, flexible, yet strong, sheet material, such as leather, cloth or man-made materials, or combinations thereof, and is usually sewn together and formed up on a last prior to its assembly with the balance of the shoe components. To facilitate this latter operation, the upper portion 2 may incorporate a lasting board or liner 4 (see FIG. 5) that spans the length and width of the underside of the upper and acts as a closure to its lower margin.

Attached to the underside of the upper portion 2 is a sole portion 5 that underlies the lower surface of the wearer' foot and supports it against the ground and the shocks and impacts of walking, running and jumping activities. In modern athletic shoes, the sole portion frequently includes a midsole portion 6, which is typically molded of a resilient, shock-absorbing, foamed material such as polyurethane ("PU") or ethylene vinyl acetate ("EVA"), and which may extend through only a part of, or throughout, the entire structure of the sole portion.

In the exemplary embodiment shown, the sole portion 5 involves a so-called "cup sole" type of construction, which means that the upper surface 7 of the midsole 6 is formed to include an upwardly-facing cup into which the upper portion 2 is received during attachment of the two portions, and the sidewalls 8 of the midsole cup may be extended upwardly to lap, and be adhered to, the upper portion for added lateral support of the foot and to provide enhanced adhesion with the upper.

The upper surface 7 of the midsole thus defines a "footbed" for supporting the wearer's foot through the agencies of the lasting board or liner 4, and optionally, a sock liner (not illustrated) made of a padded material that carried loosely at the bottom of the upper portion above the lasting liner 4 and below the foot.

Because typical midsole materials tend to wear relatively poorly, the midsole portion 6 is usually provided with an outsole layer 9 attached to its lower surface that bears directly against the ground to resist the scuffing and wear incident to most athletic activities, as well as to provide enhanced traction. Typical outsole materials include many types of rubbers, both natural and man-made, as well as certain PU's.

Thus, in the typical exemplary athletic shoe I shown in the figures, the buildup of structures that is disposed between the underside of wearer's foot and the ground comprises, in descending order, a sock liner (not shown), a lasting board or liner 4, the midsole portion 6, with its footbed-defining upper surface 7, and the outsole layer 9.

Figure 5:
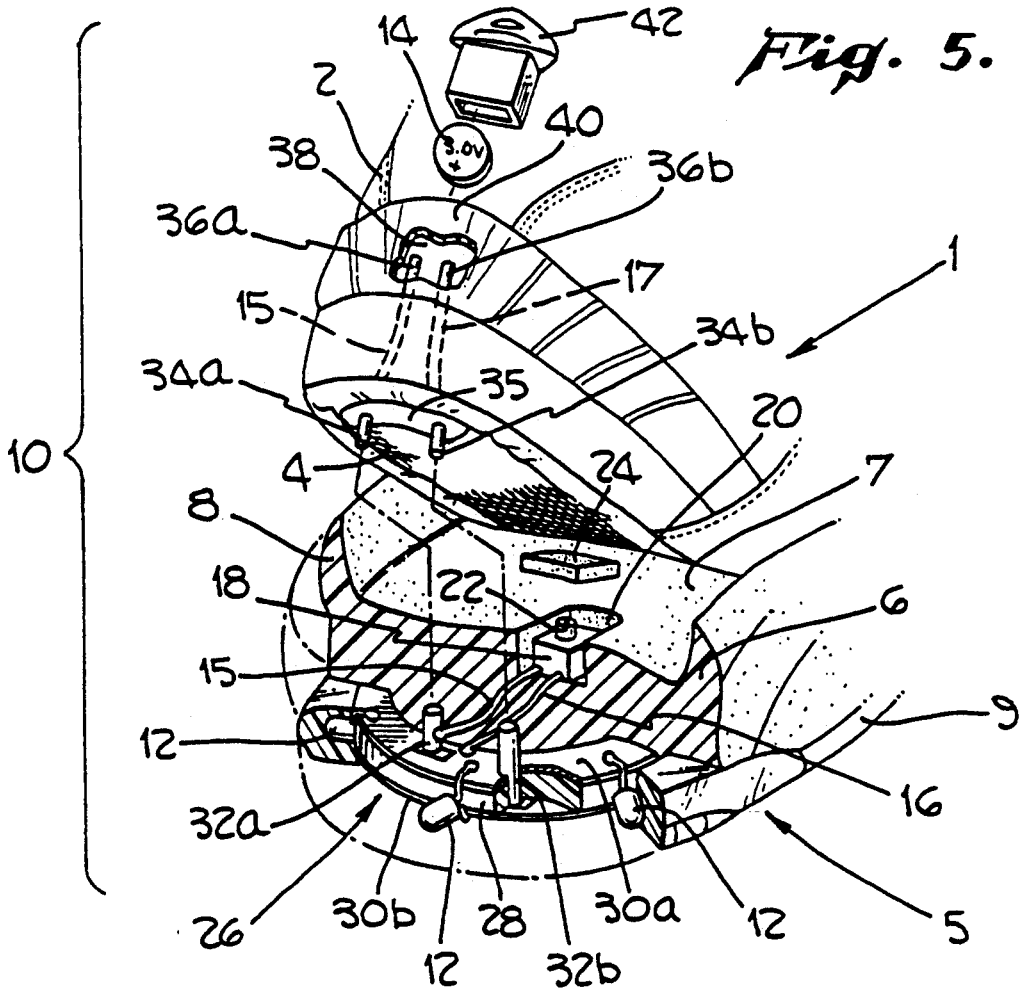
FIG. 5 is an enlarged, partial, rear perspective view of the shoe shown in FIG. 1, which is partially cut away and exploded to show the details of the lighting parts of the present invention.

Shown in exploded detail in FIG. 5 in the context of the above-described athletic shoe 1 is an exemplary preferred embodiment of the lighting system 10 that is the subject of this invention. The system 10 comprises at least one light source 12 disposed in the shoe 1 such that light emitted from the source is visible exteriorly of the shoe.

In the embodiment shown, a plurality, viz., three of such light sources 12 are shown disposed in the sole portion 5 of the shoe immediately adjacent to a lateral sidewall thereof, and, as shown, are disposed in a spaced, lateral array about the heel of the shoe such that light radiating from them through the sidewall of the sole portion may be seen through the entire arc extending from the medial side of the shoe, through its rear aspect, and to the lateral side of the shoe.

Where the material of the sidewall is opaque, it is necessary to form openings through it that are coincident with the light sources 12 so that their light can be seen through the sidewall. However, in the preferred embodiment illustrated, this is unnecessary, because the sidewall of the sole portion has been formed to include an upwardly-lapping extension of a segment of the outsole layer 9, which segment is made of a transparent or translucent material so that the light sources can be seen through it. It has been found that, in this form of construction, the light radiating from any one of the sources is less intense than that from a source that is not so obscured, because of the diffusion of the light in the outsole layer. However, this effect is not necessarily undesirable, because the light that is diffused tends to diffuse throughout the entire layer, giving the entire layer the appearance of being illuminated.

Although the light sources 12 are shown disposed in the sole portion 5 of the exemplary footwear illustrated, it will be recognized that these may located elsewhere on the shoe to good effect, e.g., on the upper portion 2.

In the exemplary embodiment, light emitting diodes ("LED's") are shown as the preferred form of light sources 12. However, skilled practitioners will recognize that other light sources may also be used to good effect, e.g., incandescent bulbs or gas-discharge tubes. LED's are advantageous because they are small, inexpensive, simple to implement, and tend to consume less power for the amount of light that they produce, relative to other types of light sources. Of course, they also have some limitations. One includes the fact that, at this time, they can produce only certain colors of light, e.g., red, green, or yellow, and cannot produce white light. Another relates to their "unidirectional" character, i.e., they require voltage of a given polarity across their leads to function, and if reverse-biased, will not light. However, this latter limitation may be turned to good advantage to achieve a "master switch" or "deactivation switch" function in a manner described in more detail hereinbelow.

Figure 2:
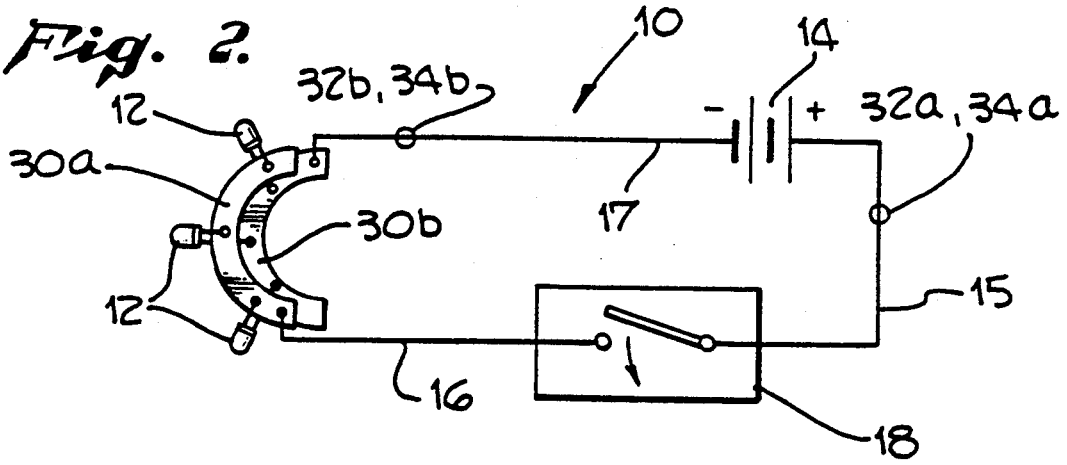
FIG. 2 is a partially-schematic diagram of the lighting circuit contained in the shoe illustrated in FIG. 1.

Shown in FIG. 2 is a partial schematic diagram of the lighting system 10 detailed in FIG. 5. As seen in the schematic, the system further comprises a power source 14, e.g., a battery, for energizing the light sources 12, circuit means 15, 16, and 17 for electrically connecting the power source to the light sources, and switch means 18 for selectably connecting the power source to and from the light sources in the desired fashion.

In the preferred embodiment of this invention, the switch means 18 are chosen to be operatively responsive to open when the wearer's foot is applied to the ground, and to close and remain closed when the wearer's foot is removed from the ground, for the reasons given hereinabove. More particularly, the switch means 18 are operatively responsive to open when the wearer's weight is applied to the ground through the agency of the sole portion 5 of the shoe, and to open when the wearer's weight is lifted from the ground through such agency.

To achieve this effect, a force- or pressure-sensing switch 18 is chosen as the switching means, and this switch is disposed in the sole portion 5 of the footwear between the wearer's foot and the ground, and preferably, in the heel region of the sole portion directly below the calcaneus, or large heel bone, of the wearer to sense the differential in pressure, or force, exerted on the switch between the foot and the ground as the wearer's weight bears on and off the ground through the sole portion, as during walking, running or jumping.

If the footwear is equipped with a midsole portion 6, as in the case of the preferred embodiment illustrated, it is preferable to mount the switch 18 in a cavity 20 in the midsole portion, which cavity opens upwardly to the upper surface, or footbed 7, of the midsole portion, and hence, to the lower surface of the foot of the wearer. It is, of course, possible to mount the switch 18 in the sole portion 5 just above its bottom surface to achieve the same switching function, but this positioning of the switch means is not considered as convenient from a manufacturing standpoint, since the footbed of the midsole is open and accessible for insertion of components during the footwear assembly procedure, up to the point at which the upper portion 2 is finally assembled to the sole portion 5.

In the exemplary embodiment, the force- or pressure-sensitive switch 18 shown is a simple, normally-closed, mechanical switch of a type that can be purchased off-the-shelf from many electrical components supply houses. Such switches typically include metallic contacts that are biased, either together (normally closed) , or apart (normally open), by a spring or other resilient means. Such switches may include a pin or button actuator 22, and in the case of the normally-closed switch of this invention, the exertion of a force or pressure on the actuator in excess of a predetermined level, which level is equal to the force exerted by the contact-biasing means, is required to move the actuator relative to the body of the switch, causing it to trip, or open the switch. Removal of this force, of course, returns the actuator to its normal position relative to the switch body and the switch to the normally closed state or condition.

Skilled practitioners should recognize that the vertical position of the switch means 18 within the sole portion 5 of the footwear relative to the lower surface of the foot is relatively critical. This is because the displacement of the switch actuator 22 is a function of its initial position relative to the foot. Thus, if the switch 18 is mounted too high within the cavity 20, it is possible that the mere act of lacing the footwear tightly to the wearer's foot will be sufficient to open the switch, turning the light source off, irrespective of whether the wearer's foot is in contact with the ground or not. Likewise, if the switch is mounted too low in the cavity, it is possible that the switch will remain "on," or close, and the lights continuously on, regardless of the wearer's weight or the force with which the wearer's foot strikes the ground.

It has been found that this problem can be largely reduced by the interposition of a "switch moderator" 24 between the switch 18 and the wearer's foot. The switch moderator is simply a layer of resilient material, the thickness and durometer of which can be closely controlled and adjusted to control and "tune" the relative pressure sensitivity of the switch for different mounting heights, as well as different wearer weights. The switch moderator fits within the cavity 20 above the switch and below the wearer's foot, and can be die cut from resilient polymeric cellular materials, such as polyurethane foam.

In FIGS. 2-5 the switch means 18 are shown connected by the switch legs 15, 16 to another feature of the preferred embodiment of this invention, a light source mounting and connector assembly 26. The mounting and connector assembly 26 includes a base 28 of a rigid, non-conductive material, such as an epoxy-fiberglass composite, a polycarbonate, or an injection-molded thermoplastic, such as an acetyl resin. Each of a pair of electrically separate, conductive layers 30*a*, 30*b*, preferably copper plating, is disposed on spaced, opposite surfaces of the base 28.

Each of the conductive layers has a female half 32*a*, 32*b* of a pair of complementary electrical connectors attached to it for connecting respective ones of the conductive surfaces to the balance of the circuit means 15, 16, 17 by way of a mating pair of male connector halves 34*a*, 34*b* that plug into the female halves and then lead into the upper portion 2. Female connector half 32*a* is electrically isolated from the upper conductive layer 30*a* and is electrically connected to one of the legs 15 of the switch 18. The other leg 16 of the switch is electrically connected to the upper layer 30*a* and returns switched power to it. This plug-in capability on the mounting and connector assembly 26 makes it possible to assemble portions of the lighting system 10 separately in the upper portion 2 and the sole portion 5, then easily "marry" the separate electrical portions together at the point at which the upper and sole portions are attached to one another.

If the light sources 12 have lead pairs, as do the LED's shown in the preferred embodiment illustrated, respective ones of the leads can be easily soldered to respective ones of the conductive layers 30*a*, 30*b* in the manner shown such that the light sources are both mechanically supported by the mounting assembly 26 and electrically connected to the balance of the circuit means 15, 16, 17 through the conductive layers.

In this fashion, the mounting and connector assembly 26 can also serve as a convenient "jig" for fixturing the light sources 12 prior to their assembly into the shoe. Further, if the assembly 26 is appropriately contoured along its length to conform to a segment of the sidewall of the sole portion 5 adjacent to which it is to be mounted, the light sources can then be easily installed into a conforming recess in the sole portion and conformably positioned and held in place along the sidewall segment at the desired intervals with ease.

Another novel feature of a preferred embodiment of the present invention is its means for incorporating the power source 14 into the lighting system 10. In this regard, the preferred power source is a small, direct-current, dry cell battery 14. The type preferred are the disk- or button-shaped cells that are about 0.50–1.00 inches in diameter and of varying thicknesses, but typically less than about 0.25 inches. They typically provide a voltage of 3 volts d.c., may be lithium, zinc or nickel-cadmium based, and are able to provide several milliwatt-hours of power for the light sources before they require replacement. They are readily obtained from a wide variety of sources available to the average wearer.

It is desirable to provide easy means for replacing the power source when it is exhausted. In the preferred embodiment, this is accomplished by making the battery 14 plug-in replaceable from the outside of the footwear 1. To achieve this, a pair of spaced-apart, conductive metal battery contacts 36*a*, 36*b* are provided, each of which is adapted to receive one of the two side edges of the battery in slide-in fashion and to contact respective ones of the battery's poles. The contacts are formed as extensions of the male connector halves 34*a*, 34*b* that extend upwardly into the upper portion 2, as described above. The male connector halves 34*a*, 34*b* may be held in the appropriate spaced relationship and mounted to the upper by means of a plastic spacer plate 35 that attaches to the underside of the lasting board 4.

The battery contacts 36*a*, 36*b* extend upwardly into a recess 38 formed in a "battery pack" or brace 40 that is attached to the outer surface of the upper portion 2 at the heel counter. The battery pack 40 may be molded from a variety of fairly rigid plastic materials, including polyester resins, polyamide resins, or some styrenics. The molded battery recess 38 opens upwardly at the rear of the shoe to receive the battery 14, as well as a plastic battery protector cap 42, in slide-in fashion, the battery being received in the battery contacts 36*a*, 36*b* to complete the electrical circuit.

The easy plug-in battery feature described above lends itself well to the provision of another desirable function in the present invention, namely, that of a master switch or deactivation switch. As will be understood, the light source 12 of the lighting system 10 is illuminated whenever the wearer's weight is not bearing down on the ground through the sole portion 5. Therefore, it is desirable to provide a convenient means for deactivating the system when the wearer desires that the lighting feature not function, as during daylight conditions, or when the footwear is not being worn.

One means for accomplishing this is by the provision of a simple, manually actuated on-off switch within the circuit that can be selectably switched by the wearer. However, if LED's are used as the light sources, the provision of this additional component, and its expense, can be avoided by the simple expedient of removing the battery and reversing its polarity within the circuit. This has the effect of back-biasing the LED's and turning them off unconditionally. Of course, the same result may be achieved by simply removing the battery 14 from the circuit, but this solution is considered less practical because it provides an opportunity for the battery is to become separated from the shoe, and possibly, lost.

Figure 3:
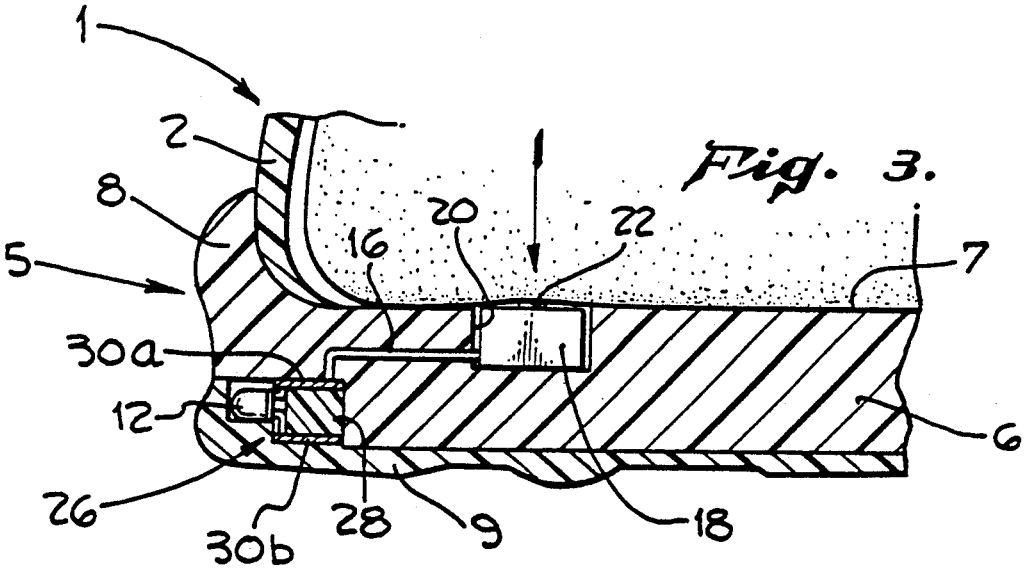
FIG. 3 is a partial cross sectional view looking into the heel region of the shoe in FIG. 1, as revealed by a longitudinal section taken through the shoe at about its midline, and showing the wearer's heel exerting a force on the switch in the direction of the arrow shown to actuate the switch to an OFF condition.
Figure 4:
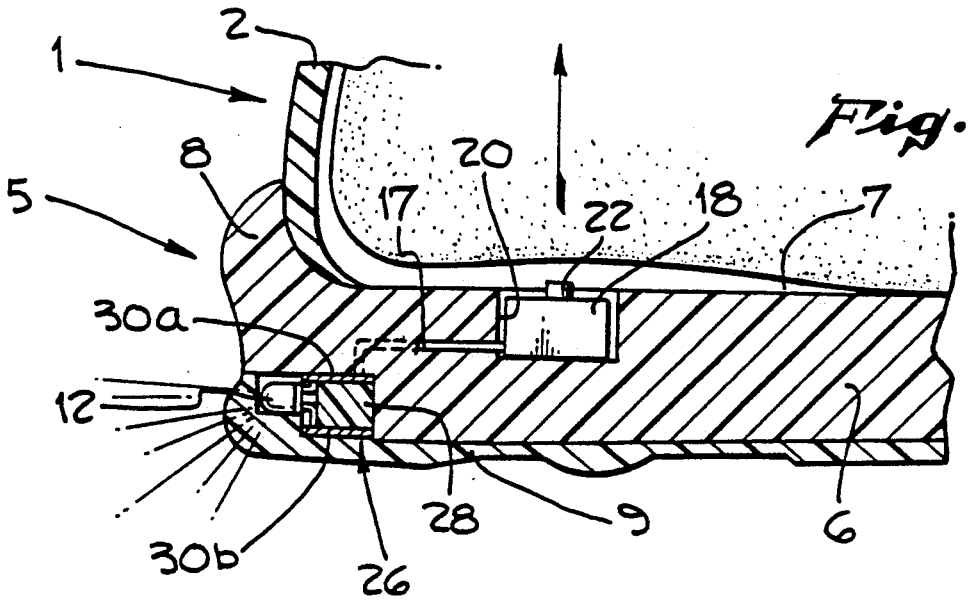
FIG. 4 is similar to FIG. 3, except that the wearer's heel is shown removing force from the switch in the direction of the arrow to return the switch to a normally ON condition.

FIGS. 3 and 4 illustrate the operation of the lighting system 10. In these Figures, the sock liner, lasting board 4, and switch moderator 24 have been omitted for clarity. In FIG. 3, the system 10 is shown in the "off" condition, occasioned by the pressure of the wearer's foot bearing on the actuator 22 of the switch 18 in the direction of the arrow shown. This condition obtains when the wearer's weight is applied to the ground through the agency of the sole portion 5, and continuously when the wearer is standing, or periodically when the wearer is walking or running and the footwear is in contact with the ground.

In FIG. 4, the footwear is shown in the "on" condition, occasioned by the pressure exerted on the switch actuator by the wearer's foot having fallen below the predetermined level necessary to return the switch 18 to its normally closed condition. This condition obtains whenever the wearer's weight, and hence, the footwear, is removed from the ground, and continuously for the period of time during which the wearer's foot is off the ground, and usually, moving.

Skilled practitioners will recognize that many modifications of the lighting system 10 can be made in terms of its materials, components and implementation within the footwear, depending on the particular problem at hand.

For example, those skilled in the electronics arts may recognize that the functions of the purely mechanical pressure switch described hereinabove, i.e. , pressure sensing and switching, might be implemented in an electro-mechanical, or solid state electronics fashion. Thus, if a simple membrane switch were interposed in the sole for the pressure switching function, and, say, a normally-closed relay, or a reverse-biased zener diode, transistor or silicon controlled switch ("SCS") were appropriately substituted for the mechanical contacts, a more sophisticated (and expensive) equivalent might be achieved.

In another variation, a simple oscillator chip can be interposed within the lighting circuit that would cause the light source to periodically flash or blink on and off during the periods when the circuit is on. Other variations might include the provision of fiber optic strands to carry light from the sole portion into various locations on the surface of the shoe, either on the sole portions, or even on the upper portion.

Accordingly, the scope of the instant invention should not be measured in terms of the scope of the exemplary preferred embodiments described hereinabove, but rather, by that of the claims appended hereinafter.

What is claimed is:

1. Footwear for improving visibility of a wearer thereof, said footwear including an upper portion contacting an upper surface of a wearer's foot and a sole portion that underlies a lower surface of the wearer's foot and supports the wearer's foot against the ground, the improvement comprising:

a light source mounted in said footwear such that light emitted from said source is visible exteriorly of said footwear;

a power source disposed in said footwear for energizing said light source;

circuit means disposed in said footwear for connecting said power source to said light source; and, switch means disposed in said footwear and operatively responsive to close when the wearer's foot is removed from the ground for selectably connecting said power source to said light source to cause illumination of said light source, said switch means being operatively responsive to open when the wearer's foot is applied to the ground, thereby extinguishing the illumination of said light.

2. The footwear of claim 1, wherein said switch means includes means, responsive to pressure from a wearer's weight applied to the ground through the agency of said sole portion, for opening said switch means and for closing said switch means when pressure from the wearer's weight is removed from the ground.

3. The footwear of claim 2, wherein said switch means includes:

an on-off switch that is in a normally closed condition, said switch having an actuator for opening said switch in response to a force exerted on said actuator and being disposed in said sole portion between the wearer's foot and the ground, with said actuator in facing communication with the ground such that, when the wearer's weight is applied to the ground through the agency of said sole portion, the ground exerts an upward force on said actuator, thereby opening said switch, and when the wearer's weight is removed form the ground through said sole portion, the force exerted on said actuator is removed, thereby returning said switch to said normally closed condition.

4. The footwear of claim 2, wherein said switch means includes:

an on-off switch that is in a normally closed condition, said switch having an actuator for opening said switch in response to a force exerted on said actuator and being disposed in said sole portion between the wearer's foot and the ground, with said actuator in facing communication with the lower surface of the wearer's foot such that, when the wearer's weight is applied to the ground through the agency of said sole portion, the lower surface of the wearer's foot exerts a downward force on said actuator, thereby opening said switch, and when the wearer's weight is removed from the ground through said sole portion, the force exerted on said actuator is removed, thereby returning said switch to said normally closed condition.

5. The footwear of claim 4, further comprising:

switch moderator means for controlling the amount of force applied to said actuator by the wearer's foot said switch moderator means including a thickness of resilient material disposed between said switch actuator and the lower surface of the wearer's foot.

6. The footwear of claim 1, wherein said light source comprises a light emitting diode.

7. The footwear of claim 6, wherein said circuit means includes:

a light emitting diode mounting and connector assembly, including a rigid, non-conductive base having a pair of distinct, conductive layers disposed on spaced, opposite surfaces thereof, each one of said conductive surfaces having a respective one of a pair of complementary electrical connectors attached thereto for connecting respective ones of said conductive surfaces to the balance of said circuit means, said light emitting diode having a pair of leads, respective ones of which are electrically and mechanically connected to respective ones of said conductive surfaces such that said diode is both mechanically supported by said assembly and is electrically connected to the balance of said circuit means through said conductive layers, and wherein said diode mounting and connector assembly is mounted in said sole portion of said footwear adjacent to a lateral sidewall thereof such that light emitted from said diode is visible exteriorly of said footwear through said lateral sidewall of said sole portion.

8. The footwear of claim 7, further comprising:

master switch means disposed in said footwear for deactivating said circuit means.

9. The footwear of claim 8, wherein said light source comprises:

a battery disposed within said circuit means, said battery having a given polarity therein necessary to light said diode, and wherein said master switch means further comprises:

means for reversing said given polarity of said battery within said circuit means.

10. The footwear of claim 9, wherein said battery and said polarity of said battery within said circuit means are plug-in replaceable and reversible, respectively, from outside of said footwear.

11. The footwear of claim 1, further comprising:

means for causing said light source to blink on and off when said switch means are closed.

12. Footwear with means for increasing visibility of a wearer thereof, comprising:

a flexible upper for enclosing an upper portion of a wearer's foot;

a sole portion for underlying a lower surface of the wearer's foot and supporting the wearer's foot against the ground, said sole portion being attached to said upper portion and having an upper surface defining a footbed for supporting the lower surface of the wearer's foot, and an outsole surface for contacting the ground;

an electric light source mounted in said footwear such that light emitted from said source is visible exteriorly of said footwear;

a battery disposed in said footwear for energizing said light source;

an electrical circuit disposed in said footwear for connecting said battery to said light source; and a pressure switch, disposed in said sole portion of said footwear between said footbed and said outsole surface for selectably connecting and disconnecting said light source to and from said battery, said pressure switch being in a normally closed state such that said light source is connected to said battery, said pressure switch including means, operatively responsive to pressure of a predetermined level, for changing said pressure switch from said normally closed state to an open state, and for returning said pressure switch to the closed state when said pressure is reduced below said predetermined level.

13. The footwear of claim 12, wherein said sole portion comprises:

a resilient midsole portion disposed between said upper portion and said outsole surface of said sole portion, said midsole portion having an upper surface and a cavity formed therein that open to said midsole upper surface and the lower surface of the wearer's foot, and wherein said pressure switch is disposed within said cavity.

14. The footwear of claim 13, further comprising:

a layer of resilient material disposed above said cavity between said pressure switch and the lower surface of the wearer's foot for moderating and controlling the amount of pressure applied to said switch by the wearer's foot and the ground.

15. The footwear of claim 12, further comprising:

deactivation switch means disposed in said footwear and within said circuit for selectably disconnecting said battery from said light source independently of the state of said pressure switch.

16. The footwear of claim 15, wherein:

said light source is a light emitting diode, whereby said battery requires a given polarity within said circuit in order to light said diode, and wherein said deactivation switch means includes:

means for reversing said polarity of said battery within said circuit.

17. The footwear of claim 15, wherein:

said battery and said polarity of said battery within said circuit are plug-in replaceable and reversible, respectively, from outside of said footwear.

18. The footwear of claim 12, further comprising:

a light source mounting and connector assembly, including a base of a rigid, non-conductive material, said base having a length and a pair of separate, conductive layers disposed on spaced, opposite surfaces thereof, each one of said conductive surfaces having a respective one of a pair of complementary electrical connectors attached thereto for connecting respective ones of said conductive surfaces to the balance of said electrical circuit, said light source having a pair of leads, respective ones of which are electrically and mechanically connected to respective ones of said conductive surfaces such that said light source is both mechanically supported by said assembly and is electrically connected to the balance of said circuit means through said conductive layers, and wherein said assembly is mounted in said sole portion of said footwear adjacent to a lateral sidewall thereof such that light emitted from said light source is visible exteriorly of said footwear through said lateral sidewall.

19. The footwear of claim 18, wherein:

said conductive layers each comprise a layer of cooper, said light source comprises a plurality of light emitting diodes, each of said diodes having a pair of leads, with respective ones of said leads being connected to respective ones of said copper layers such that said diodes are electrically connected in parallel within said circuit and mechanically supported at intervals along the length of said base with said diodes facing away from said base, and wherein said assembly is shaped to conform to a segment of said sidewall of said sole portion such that said diodes are conformably positioned and supported along said sidewall segment.

20. The footwear of claim 12, further comprising:

oscillator circuit means disposed in said circuit for causing said light source to flash periodically when said pressure switch is in said closed state.

* * * * *